United States Patent [19]

Nemoto et al.

[11] Patent Number: 4,961,704

[45] Date of Patent: Oct. 9, 1990

[54] SHEET MEANDERING MOVEMENT PREVENTING METHOD

[75] Inventors: Shigeo Nemoto; Osamu Namikawa; Kiyomi Tsuchiya; Isao Nakajima; Yasuo Kikuchi; Tomio Sugaya; Toshitaka Ogawa; Sigenobu Katagiri, all of Ibaraki, Japan

[73] Assignee: Hitachi Koki Company, Ltd., Tokyo, Japan

[21] Appl. No.: 377,755

[22] Filed: Jul. 7, 1989

Related U.S. Application Data

[63] Continuation of Ser. No. 188,869, May 2, 1988, abandoned.

[30] Foreign Application Priority Data

Apr. 30, 1987 [JP] Japan ..... 62-107600

[51] Int. Cl.[5] ..... F27B 9/28

[52] U.S. Cl. ..... 432/8; 432/59; 219/216; 219/469

[58] Field of Search ..... 432/8, 59, 60, 228; 219/469, 216

[56] References Cited

U.S. PATENT DOCUMENTS

| | | | |
|---|---|---|---|
| 4,119,831 | 10/1978 | Sato | 432/60 |
| 4,440,486 | 4/1984 | Isaka et al. | 219/216 |
| 4,473,290 | 9/1984 | Iwao | 432/60 |

*Primary Examiner*—Henry C. Yuen

*Attorney, Agent, or Firm*—Sughrue, Mion, Zinn, Macpeak & Seas

[57] ABSTRACT

In a printing sheet conveying device in which a sheet bearing a toner image is passed through a heating roll and a pressure roll, and which has means for changing the right and left contact pressures of these rolls to correct the meandering movement of the sheet when conveyance of the sheet is started; in which when conveyance of the sheet is started, the contact pressure of the rolls is made higher on one of the right and left sides than on the other side, and in a predetermined period of time the contact pressures on both sides are made equal to each other.

3 Claims, 3 Drawing Sheets

SHEET MEANDERING MOVEMENT PREVENTING METHOD

This is a continuation of application Ser. No. 188,869 filed May 2, 1988, now abandoned.

BACKGROUND OF THE INVENTION 1. (Technical Field of the Invention)

This invention relates to a method of preventing the meandering movement of a printing sheet in an electro-photographic apparatus.

2. (Prior Art)

The operation of an electro-photographic apparatus such as a laser beam printer will be described with reference to FIG. 2. A printing sheet 201 is conveyed by means of upper and lower tractors 204 and 203 at a speed equal to the peripheral speed of a photo-sensitive drum 202. A toner image (not shown) is transferred onto the printing sheet 201 by means of a transfer unit 210. Thereafter, tension is given to the printing sheet 201 by a buffer as required. Under this condition, the printing sheet 201 together with the toner image is heated and pressurized by means of a heating roll 207 and a pressure roll 208 so that the toner image is fixed to the printing sheet 201. The printing sheet 201 thus treated is pulled under a predetermined tensile force by a puller 213 and a pressure roll 212, so that it is delivered into a stacker (not shown).

As is apparent from the above description, in the above-described operation, the pin drive provided by the upper and lower tractors 204 and 203 and the frictional drive provided by the heating roll 207 and the pressure roll 208 are utilized for conveyance of the printing sheet 201. When the printing sheet 201 is conveyed by the frictional force provided by the heating roll 207 and the pressure roll 208, since no means for preventing the widthwise movement of the printing sheet is provided the printing sheet meanders right and left, as a result of which stress is applied to the printing sheet 201, thus breaking the conveying perforations or creasing the printing sheet.

In order to overcome the above-described difficulty, means 209 for correcting the meandering movement of the printing sheet 201 (hereinafter referred to as "meandering movement correcting means 209") is provided. In this case, the meandering movement of the printing sheet 201 is detected by a sensor 211, and the contact pressure of the heating roll 207 and the pressure roll 208 is adjusted with respect to the axial direction of the heating roll 207. The meandering movement correcting means 209, as shown in FIG. 3, comprises: a left arm 301 and a right arm 302 supporting both ends of the pressure roll 208 which is abutted against the heating roll 207; and an electric motor 304 for driving the right and left arms through a wire 303. The right and left arms 302 and 301 are swung about their own fulcrums in the opposite directions by the electric motor 304 so that the contact pressure of the pressure roll 208 against the heating roll 207 is changed along the axial direction of the latter 207. That is, with the meandering movement correction means, the difference in peripheral speed between the ends of the heating roll 207 and the pressure roll 208 which is due to the deformation is utilized to correct the meandering movement of the printing sheet 201.

The correction of the meandering movement of the printing sheet 201 will be described with reference to FIG. 4 in more detail. When it is necessary to bend the direction of movement of the printing sheet 201 towards on side A in FIG. 4, the contact pressure of the heating roll 207 and the pressure roll 208 is made higher on the side A than on the other side B. In this case, in each of the rolls 207 and 208, the radius rA on the side A is smaller than that rB on the side B, and therefore the peripheral speed vrB on the side B is higher than the peripheral speed vrA on the side A ($vrA < vrB$). Accordingly, the amount of movement of the printing sheet 201 is larger on the side B than on the side A; that is, the direction of movement of the printing sheet 201 is changed towards the side A. When, in contrast, it is required to bend the direction of movement of the printing sheet towards the side B, the contact pressure of the heating roll 207 and the pressure roll 208 is made lower on the side A than on the side B. In this case, the printing sheet 201 is shifted towards the side B.

The heating roll 207 is a both-ends-supported roll having a drive source, namely, an electric motor 101 on one end. Therefore, as shown in FIG. 1, for a very short period of time immediately after the printing sheet 201 is driven by the heating roll 207, because of the torsional twisting of the heating roll 207 the drive force is transmitted from the driving side A toward the non-driving side B in a twist mode. Accordingly, the angular speed of the heating roll 207 is higher on the driving side A than on the non-driving side B; that is, a condition $wA > wB$ is established. Accordingly, with the heating roll 207 uniform in diameter, the peripheral speed is higher on the side A than on the side B ($vA > vB$). Under this condition, the amount of movement of the printing sheet 201 being conveyed is larger on the side A than on the side B, and therefore the direction of movement of the printing sheet 201 is bent towards the side B.

Thereafter, in a very short period of time, the drive force is transmitted uniformly in the heating roll 207, and the entire surface of the heating roll 207 becomes constant in peripheral speed. Under this condition, the amount of movement of the printing sheet 201 on the driving side A is equal to that of the printing sheet on the non-driving side B. Therefore, as shown in FIG. 5, a returning force which the puller 213 and the pressure roll 212 provide in response to the bending of the direction of movement of the printing sheet towards the non-driving side B and the rigidity of the printing sheet 201 in the widthwise direction shift the printing sheet 201 towards the driving side A.

On the other hand, the meandering movement correcting means 209 utilize the difference in peripheral speed between the right and left ends of the heating roll 207 and the pressure roll 208, to make the amount of movement of the printing sheet on the driving side equal to the amount of movement of the printing sheet on the non-driving side or vice versa. Therefore, in order to correct the meandering movement of the printing sheet, it is necessary to operate the meandering movement correcting means 209 for a period of time for which the printing sheet 201 is shifted to cover the difference in the amount of movement between the two sides A and B. Therefore, even if, when at the start of the conveyance of the printing sheet the sensor 211 detects the meandering movement of the printing sheet, the meandering movement correcting means is operated, it is impossible to completely eliminate the meandering movement of the printing sheet. In other words, immediately after when the conveyance of the printing sheet is started, the printing sheet is unstable being swung right and left.

SUMMARY OF THE INVENTION

Accordingly, an object of this invention is to eliminate the above-described difficulty accompanying a conventional method of correcting the meandering movement of a printing sheet in an electro-photographic apparatus.

More specifically, an object of the invention is to provide a method of preventing the meandering movement of a printing sheet in an electro-photographic apparatus in which a printing sheet is prevented from meandering at the start of the printing operation.

The foregoing object and other objects of the invention has been achieved by the provision of a method of preventing the meandering movement of a printing sheet in a sheet conveying device in which a sheet bearing a toner image is passed through an electric heating roll rotatably supported and having a drive source and an elastic pressure roll held in roll contact with the elastic heating roll by a frictional force provided therebetween, and which has means for changing the right and left contact pressures of the heating roll and pressurizing roll to correct the meandering movement of the sheet when conveyance of the sheet is started; in which when conveyance of the sheet is started, the contact pressure of the heating roll and pressure roll is set higher on one of the right and left sides in the axial direction of the heating roll than on the other, and in a predetermined period of time the contact pressure on the one side is made to equal to that on the other side thereby to prevent the meandering movement of the sheet in the axial direction of the heating roll at the start of the conveyance of the sheet.

In a roll which is supported at both ends and having a driving source at one end, according to this invention, when the conveyance of the printing sheet is started, the pressure is applied to the roll on the driving side, and thereafter the pressure thus applied is made to be in balance with the pressure on the non-driving side after an appropriate period of time elapses, paying attention to the fact that (1) the driving force is transmitted from the roll on the driving side at the time of the start of conveyance of the printing paper due to the torsional twisting of the roll so that the peripheral speed of the heating roll near the driving side is higher than that far from the driving side; (2) in the case where the angular speed is constant, the roll with its smaller diameter is lower than that with its larger diameter in peripheral speed; and (3) the roll is compressed by application of pressure thereby to decrease its diameter in dimension.

The nature, principle and utility of the invention will become more apparent from the following detailed description when read in conjunction with the accompanying drawings.

DETAILED DESCRIPTION OF THE INVENTION

Figure 1:
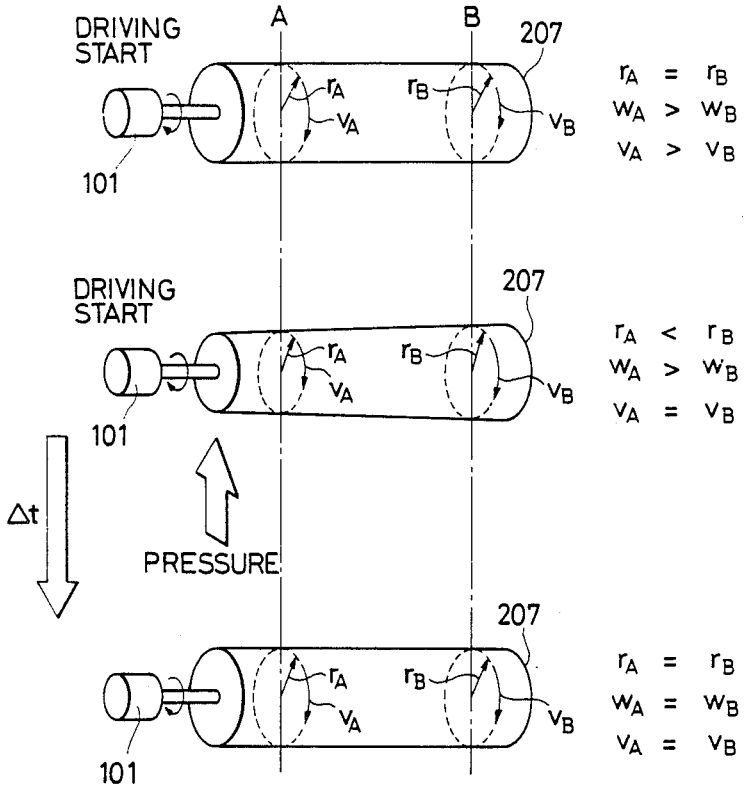
FIG. 1 is a diagram for a description of the operating principle of this invention.
Figure 2:
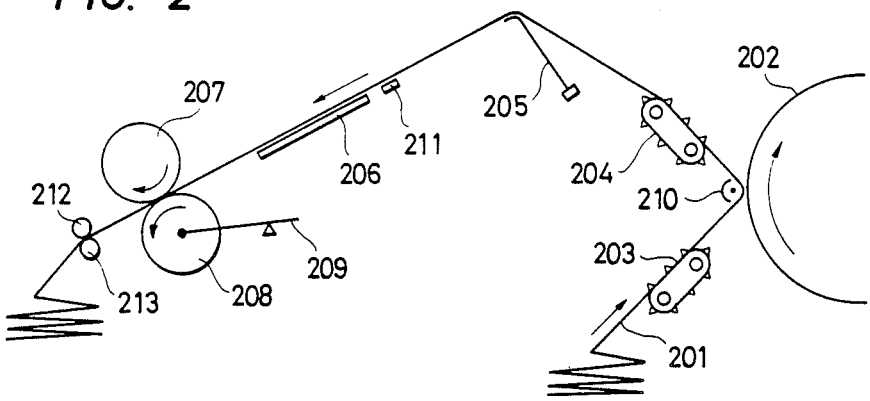
FIG. 2 is an explanatory diagram outlining a sheet conveying path in a laser beam printer.

One example of a method of preventing the meandering movement of a printing sheet will be described with reference to the accompanying drawings.

Components employed in the method of the invention which are functionally equal to those in the abovedescribed conventional method are designated by the same reference numerals or characters.

As shown in FIG. 1, when driving the heating roll 207 is started, because of the torsional twisting of the heating roll 207 the drive force is transmitted from the driving side A to the non-driving side B in a twist mode, and therefore the angular speed wA of the heating roll 207 on the side A is higher than that wB of the heating roll 207 on the side B, or the angular speed of the heating roll 207 is lower towards the side B; that is, $wA > wB$. Accordingly, the peripheral speed vA on the side A is higher than that vB on the side B, and the amount of movement of the printing sheet 201 is larger on the side A than on the side B. As a result, the direction of movement of the printing sheet 201 is bent towards the side B.

In order to eliminate this difficulty, it is essential that the heating roll 207 is uniform in peripheral speed when driven; that is, the peripheral speed of the heating roll 207 on the driving side A should be equal to that of the heating roll on the non-driving side B ($rA\ wA = rB\ wB$). That is, when the heating roll 207 is driven, because of $wA > wB$, $rA < rB$ should be established.

Figure 3:
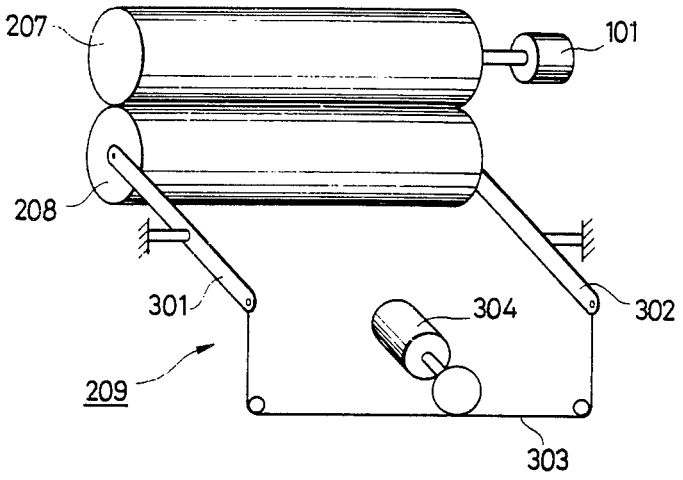
FIG. 3 is an explanatory diagram outlining the arrangement of meandering movement correcting means.
Figure 4:
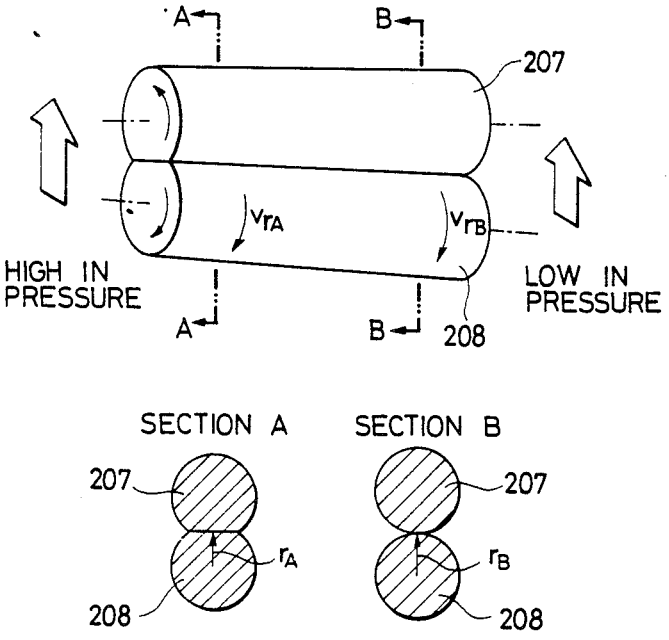
FIG. 4 is an explanatory diagram for a description of the conditions of a heating roll and a pressure roll in the operation of the meandering movement correcting means.
Figure 5:
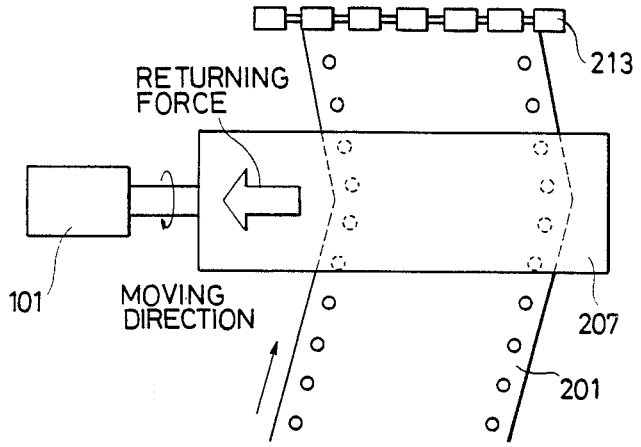
FIG. 5 is a top view of the heating roll and a printing sheet at the start of conveyance of the printing sheet.

Therefore, the meandering movement correcting means 209 as shown in FIG. 3 is used to make the contact pressure of the heating roll 207 and the pressure roll 208 higher on the driving side A than on the non-driving side B. In this case, the heating roll 207 being compressed, the apparent radius rA on the driving side A becomes smaller than that rB on the non-driving side B as shown in the middle part of FIG. 1, and therefore when driving the heating roll 207 is started, the peripheral speed vA on the driving side A can be made equal to that vB on the non-driving side B, and accordingly the amount of movement of the printing sheet 201 on the driving side A is equal to that of the printing sheet on the non driving side B. Thus, the printing sheet 201 will not meander.

Figure 7:
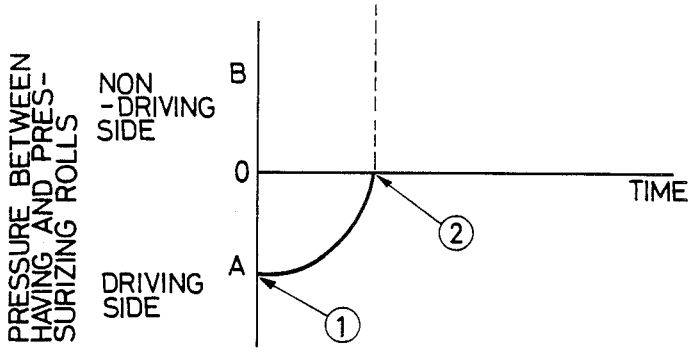
FIG. 7 is a graphical representation for a description of one example of the operation of meandering movement correcting means in this invention.

Thereafter, in a very short period of time $\Delta t$, the drive force being uniform in the heating roll 207 both on the sides A and B, the angular velocity wA on the driving side A becomes equal to that wB on the non-driving side B ($wA = wB$). Accordingly, with the pressure maintained applied on the driving side A, the peripheral speed is higher on the non-driving side B because of the larger diameter, and therefore the amount of movement of the printing sheet 201 is larger on the non-driving side B. Thus, the direction of movement of the printing sheet 201 is bent towards the driving side A. Therefore, as indicated by the curve (from (1) to (2)) in FIG. 7, the pressure applied to the heating roll 207 on the driving side A is returned to zero in pressure difference during the period of time Δt mentioned above, so that the radius rA of the heating roll on the driving side A is made equal to that rB on the non-driving side B. Thus, the peripheral speed of the heating roll 207 on the driving side A is equal to that of the heating roll 207 on the non-driving side B; that is, the amount of movement of the printing sheet 201 on the driving side A is equal to that of the printing sheet on the non-driving side B.

Figure 6:
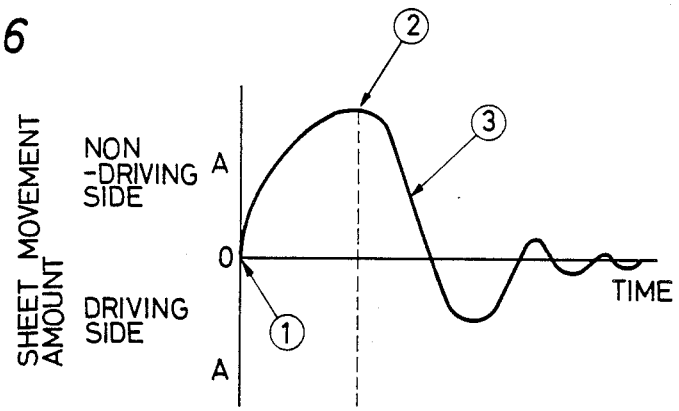
FIG. 6 is a graphical representation indicating the meandering movement of the printing sheet at the start of conveyance of the printing sheet.

Accordingly, the printing sheet 201 is allowed to move straightly, and there is no phenomenon that the printing sheet 201 is returned because of its rigidity in the widthwise direction as indicated at (3) in FIG. 6. That is, the printing sheet 201 is conveyed without any meandering movement.

In the above-described embodiment, the period of time which elapses from the time instant when the conveyance of the printing sheet is started with a pressure applied to the heating roll 207 on the driving side A until the pressure thus applied is made to be in balance with that on the non-driving side B is 0.5 second.

In the above-described meandering movement correcting means 209, the left and right arms 301 and 302 coupled through the wire 303 are operated in association with each other to provide the difference in contact pressure between the two ends of the heating roll 207, thereby to prevent the meandering movement of the printing sheet. The same effect can be obtained by using meandering movement correcting means having a mechanism for applying pressures separately to the right and left ends of the heating roll which is operated as follows:

(1) The pressure applied to the heating roll 207 on the driving side A is reduced until it becomes equal to that applied thereto on the non-driving side B after the conveyance of the printing sheet is started.

(2) The pressure applied to the heating roll on the non-driving side B is increased until it becomes equal to that applied thereto on the driving side A after the conveyance of the printing sheet is started.

As was described above, in the above-described embodiment, the period of time which elapses from the time instant when the conveyance of the printing sheet is started with a pressure applied to the heating roll 207 on the driving side A until the pressure thus applied is made to be in balance with that on the non-driving side B is 0.5 second; however, the period of time may be set to one or two seconds depending on the materials, structures and configurations of the heating roll 207 and the pressure roll 208. Furthermore, the period of time may be changed for instance with the variation in friction coefficient of the heating roll 207 or the pressure roll 208.

As is apparent from the above description, when the conveyance of the printing sheet is started, the meandering movement of the printing sheet is cancelled out by application of the corresponding force according to the invention, so that the printing sheet is conveyed straightly at all times.

What is claimed is:

1. A method of preventing the meandering movement of a sheet conveying device in which a sheet bearing a toner image is passed through an elastic heating roll rotatably supported at both ends and having a drive source at one end thereof forming a driven side for rotating said elastic heating roll and an elastic pressure roll held in roll contact with said heating roll by a frictional force therebetween, and which includes means for changing the contact pressure of said heating and pressure rolls in the axial direction of said heating roll, the method comprising the steps of:

setting the contact pressure of said heating and pressure rolls on said driven side thereof in the axial direction of said heating roll to be higher than that on a non-driven side when conveyance of said sheet is started to attendantly reduce an apparent radius of said driven side of said heating roll and thereby compensate for a higher peripheral speed on said driven side of said heating roll caused by a torsional twisting of said heating roll at start-up;

making said contact pressure on both of said driven and non-driven sides of said heating and pressure rolls equal to each other after a predetermined period of time elapses, to prevent the meandering movement of said sheet at the time of conveyance of said sheet.

2. A method as claimed in claim 1, in which said making step comprises a step of reducing said contact pressure on said driven side of said heating roll to be equal to that on said non-driven side thereof after said predetermined period of time elapses.

3. A method as claimed in claim 1, in which said making step comprises a step of increasing said contact pressure on said non-driven side of said heating roll to be equal to that on said driven side thereof.

* * * * *